US006602834B1

(12) United States Patent
Ward et al.

(10) Patent No.: US 6,602,834 B1
(45) Date of Patent: Aug. 5, 2003

(54) CUTTING AND LUBRICATING COMPOSITION FOR USE WITH A WIRE CUTTING APPARATUS

(75) Inventors: Irl B. Ward, Bethlehem, PA (US); Amy Ann Heller, Orefield, PA (US); Danielle Anne French, Bethlehem, PA (US); Susan Jane Broadway, Bethlehem, PA (US)

(73) Assignee: PPT Resaerch, Inc., Allentown, PA (US)

( * ) Notice: Subject to any disclaimer, the term of this patent is extended or adjusted under 35 U.S.C. 154(b) by 0 days.

(21) Appl. No.: 09/637,263

(22) Filed: Aug. 10, 2000

(51) Int. Cl.[7] ..... C10M 107/34

(52) U.S. Cl. ..... 508/506; 508/507; 508/511; 508/513; 508/579; 508/583; 72/42

(58) Field of Search ..... 508/506, 507, 508/511, 579, 583

(56) References Cited

U.S. PATENT DOCUMENTS

| | | | | | |
|---|---|---|---|---|---|
| 4,146,488 | A | * | 3/1979 | Martin | 252/34.7 |
| 4,461,712 | A | * | 7/1984 | Jonnes | 252/49.3 |
| 4,522,733 | A | * | 6/1985 | Jonnes | 252/49.3 |
| 4,589,992 | A | * | 5/1986 | Phillips et al. | 252/75 |
| 5,064,547 | A | * | 11/1991 | Rubin | 252/56 R |
| 5,349,149 | A | * | 9/1994 | Shiraki et al. | 219/69.14 |
| 5,484,541 | A | * | 1/1996 | Przybylski et al. | 252/17 |
| 5,616,544 | A | * | 4/1997 | Kalota et al. | 508/508 |
| 6,054,422 | A | * | 4/2000 | Ward et al. | 508/579 |
| 6,383,991 | B1 | * | 5/2002 | Hashimoto et al. | 508/161 |

* cited by examiner

*Primary Examiner*—Ellen M. McAvoy
(74) *Attorney, Agent, or Firm*—John Lezdey

(57) ABSTRACT

The invention provides a cutting and lubricating composition with abrasive particles for cutting hard and brittle workpieces with a wire saw or other cutting or grinding tool. The composition provides electrostatic and steric repulsion between the abrasive particles to maintain the particles in suspension without forming hard settled cakes from suspension "fall-out".

17 Claims, 2 Drawing Sheets

CUTTING AND LUBRICATING COMPOSITION FOR USE WITH A WIRE CUTTING APPARATUS

BACKGROUND OF THE INVENTION

1. Field of the Invention

This invention relates to a novel cutting and lubricating composition for use with an apparatus for cutting workpieces of hard and brittle material such as semiconductor ingots of silicon, germanium, gallium arsenide or glass or other brittle materials, such as granite block, or ceramics or steel parts into a multiplicity of thin sheets, slices, wafers, or precision machined parts with abrasive particles which are kept in suspension.

2. Description of the Prior Art

For one of the major applications of the invention, the cutting apparatus, referred to as a "wiresaw" or "wire-web", usually comprises a row of fine wires arranged parallel to each other and at a fixed pitch. A workpiece is pressed against these fine wires having diameters in the order of 0.15–0.2 millimeters running in parallel with one another in the same direction, while an abrasive suspension fluid is supplied between the workpiece and the wires, thereby slicing the workpiece into wafers by an abrasive grinding action. The liquid suspended abrasive particles are coated onto the moving "web" or wire through a circulation system which drops a "blanket-curtain" of the abrasive suspensions onto the "web" just before the wire-web impacts the workpiece. Thus, the abrasive particles carried by the liquid are transferred via the coated wires to produce a grinding or cutting effect. The above described splitting units or machines, called wiresaws, are described in U.S. Pat. Nos. 3,478,732, 3,525,324, 5,269,275 and 5,270,271, which are incorporated by reference.

The cutting apparatus may also comprise a series of wires inter-looped or entwined together in a braided loop configuration. This configuration can be used for the cutting of granite block or silicon ingots. The workpiece is pressed against the braided wire and the cutting process is augmented by the abrasive particles as described above.

Achieving an optimum cutting quality depends on a combination of parameters, the quality of the abrasive fluid and the force with which the workpiece is pressed against the set of abrasive coated wires.

Effort is now directed to optimizing the cutting quality obtained under mass production conditions. By cutting quality is meant exact planarity of the surfaces without taper and thickness variation to yield products suitable for semiconductor devices, solar cells, and optical glass, among others. Mass production considerations, for example, the rate of wear of the wire, the effectiveness recovery and recycling of the cutting and lubricating fluids are also important. U.S. Pat. No. 5,099,820 issued to Stricot discloses an abrasive liquid as a suspension of particles of silicon carbide in water or oil. However, these prior art suspensions are not stable and do not provide uniform coating on the "cutting" wires. Furthermore, these compositions require vigorous agitation to maintain uniform suspension of the particles, and the suspension settles out quickly under stagnant conditions, and even during workpiece slicing while still under agitation.

Thus, there exits a need for a novel cutting and lubricating composition which provides a uniform supply of homogeneously dispersed abrasive material without abrasive particle agglomeration or "hard-cake" formation from suspension fall-out so that the workpiece is more efficiently cut by the abrasive grains or grit in the composition. Further, the composition should have excellent lubricity and heat transfer properties to remove the frictional heat generated at the cutting site thereby increasing working life of the wire and avoiding downtime. Finally, the composition should provide a stable suspension of abrasive particles. However, if stored for a long period and separation occurs, only a gentle agitation should be required to restore the suspension.

The role of surfactants and electrolytes or polyelectrolytes in the preparation of suspension concentrates is described by the effect on the wetting of the powder by a liquid, breaking the aggregates and comminution of the resulting particles into smaller units. The role of the surfactant and polyelectrolyte in controlling colloidal stability is described in the interaction forces between the particles. These interaction forces are classified into electrostatic, van der Waals and steric repulsion. With polyelectrolytes, stability is primarily the result of a combination of electrostatic and steric repulsion.

SUMMARY OF THE INVENTION

According to the broadest aspect, the present invention relates to a cutting and lubricating composition for use with an apparatus for cutting workpieces of a hard and brittle material such as semiconductor materials, magnetic materials, ceramics, granite block, solar energy components, and the like. Further, such compositions are effective and useful for the precision cutting of metal or ceramic parts as components for tools, automotive, machine or other type devices. Other applications of this invention can be easily conceived by those skilled in the art when the suspension benefits of this invention provide advantageous performance results, such as in the grinding of hard substrates. More specifically, the lubricating composition, which may contain up to 70% (wt/wt) of an abrasive material preferably comprises:

a) from about 0.0 to 10 weight percent of an ionized surfactant;

b) from about 86 to 99.5 weight percent of a non-aqueous, non-ionic, polar solvent such as polyalkylene glycols or the co-glycols thereof, and c) an organic electrolyte or polyelectrolyte with a repeating chain pendant group having the same charge on the repeating chain pendant group as said surfactant and present in an amount to cause a sufficient electrostatic repulsive force between said abrasive particles and the surrounding liquid medium containing said polyelectrolyte to prevent both hard-cake settling and particle agglomeration of said particles when such particle suspension is subjected to stagnant storage over an extended time period at ambient or elevated temperature. Generally about 0.05 to 10.0% by weight of said polyelectrolyte is utilized, preferably between about 0.5 to 4% by weight of the carrier composition.

Advantageously, less than 10% by weight of water is present.

Thickeners may be added to the composition, which includes carboxylmethylcellulose, methylcellulose, polysaccharides, and the like, familiar to those skilled in the art. Additionally or optionally, dispersing solvents or suspension agents such as those described in U.S. Pat. No. 6,054,422 and including but not limited to, tripropglene glycol methyl ether, DPM, NMP, DMAC, DAM, and the like can be added as needed for viscosity adjustment, better slurry rinseability, etc.

A preferred substantially non-aqueous lubricating/suspension composition comprises:

a) from about 0.0 to 1 weight percent of an anionic surfactant;

b) from about 0.1 to 4 weight percent of an anionic organic polyelectrolyte or electrolyte, c) from about 91 to 99.5 weight percent of a polyethylene glycol solvent, and d) from about 0.0 to about 5% percent water, with the proviso that the electrolyte or polyelectrolyte is in the neutralized form ranging in pH from about 4.5 to about 8.0, preferably less than 7.

Most preferably, according to the present invention is provided a lubricating carrier composition which comprises:

a) about 93.5 to 99 weight percent of polyethylene glycols wherein said polyethylene glycols consist of a molecular weight of from about 200 to 600; and whereby the viscosity of the composition is about 50–300 cps under room temperature conditions (25° C.), b) about 0.1 to 0.5 weight percent of a fluorinated anionic surfactant, c) about 0.4–3.0 weight percent of an anionic polyelectrolyte neutralized to a pH of about 4.5–6.0, and d) about 0.5–5.0 weight percent of water It is therefore a primary object of this invention to provide a lubricating/suspension composition for a "multi-wire" machine for cutting a hard and brittle material which increases production efficiency and quality of the sliced sheet or wafer.

Normally about 40 to 50% by weight of abrasive particle material is dispersed and suspended in the carrier/lubricating composition.

It is another object of this invention to provide a cutting and lubricating composition which allows for the uniform distribution of the abrasive material to the coating of the cutting wire.

It is a further object of this invention to provide a lubricating composition which is fully water soluble, water miscible and of very low toxicity.

Yet another object of the invention is to provide a cutting and lubricating composition wherein the abrasive cutting material is suspended in the composition and remains suspended without hard-cake formation or particle agglomeration even over long periods of stagnant storage.

Yet a still further object is to provide high quality sliced sheets or wafers suitable for semiconductor and solar devices.

Other objects and applications for the composition invention and a more complete understanding of the invention will be had by referring to the following drawings and description.

DETAILED DESCRIPTION OF THE PREFERRED EMBODIMENTS

Figure 1:
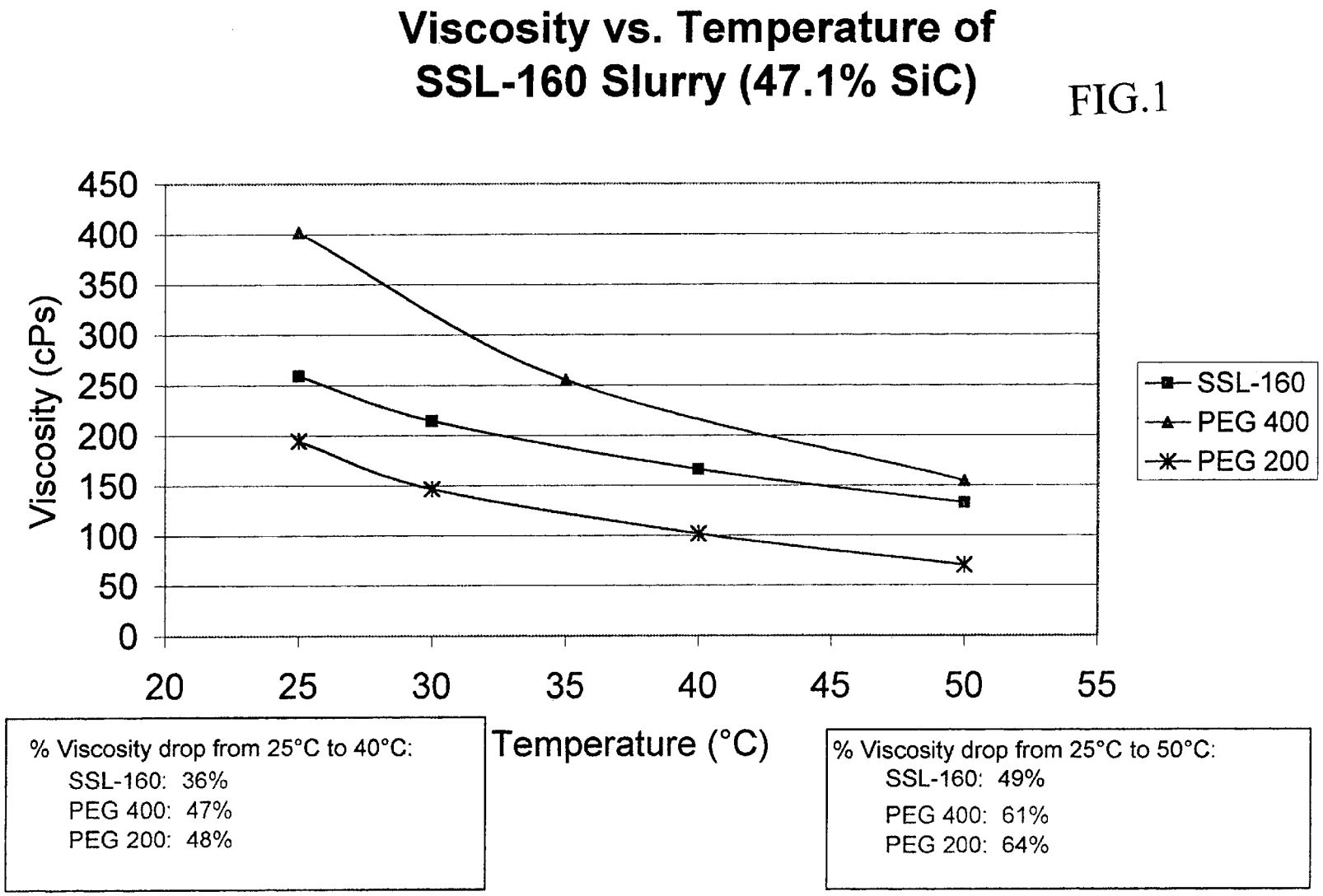
FIG. 1 illustrates comparative viscosities of a composition of the inventions.

The present invention combines the general "charged particle" principles of "Zeta Potentials" and "Stern/Diffuse Layers" of charged particles with a new unique principle of creating an overall REPULSIVE CHARGED MEDIUM inside the polar, but non-ionic solvent "carrier/lubricating" system. There is employed the concept of electrolytes or more preferably, polyelectrolytes in order to accomplish the task of creating an electrostatic repulsive solvent medium out of non-ionic solvents such as polyethylene glycol (PEG) or even "mineral oils". Since the force of charge repulsion in an inert uncharged medium between two particles of the same charge type is simply defined by the classical physics equation:

$$F=kq(1)q(2)/d(E2)$$

Then, the higher the charge on the particle (q) the greater the force of repulsion as the particles approach one another. In the invention, we purposefully "charge" the non-ionic solvent medium with EITHER "like" or "oppositely" charged polyelectrolytes or electrolytes which can be adequately dispersed or dissolved in the solvent. By "charging" the non-ionic medium with a "like" negative polyelectrolyte, the repulsive forces between the negatively charged SiC particles in dispersion is INCREASED over that calculated by the equation above. Additionally, the "free-space" between charged species is significantly reduced making over particle-particle and particle-medium repulsion even greater. This, of course, makes agglomeration of the negatively charged abrasive particles such as SiC within the medium even more difficult than in the normal "non-ionic" solvent such as PEG or mineral oil.

With the solvent system charged with negatively charged polyelectrolytes, the abrasive particles, such as SiC, not only repel each other, but are also constantly being repelled by the charged polyelectrolytic species within the medium. SOFT SETTLE characteristics, defined as the ability of the suspension to prevent the settling out or agglomeration of grit particles into a "hard" cake at the bottom of a container on stagnant storage over time, are greatly enhanced by the inclusion of charged polyelectrolytes within the solvent system over that of solvent alone or non-polar solvent and a dispersing solvent.

Examples of the repeating monomer units of "negatively charged" organic polyelectrolytes (anionic PE) suitable for dispersion or dissolution in this non-ionic medium include but are not limited to pH neutralized:

acrylic acid;

methacrylic acid;

alkenyl sulfonic acids aromatic alkenyl sulfonic acids (ie: styrene sulfonic acid)

alkylacryloxy sulfonic acids (ie: 2-methacryloxyethylsulfonic acid)

acrylamidosulfonic acids, and the like co-polymers of combinations of the above or other suitable monomer units.

Preferred anionic polyelectrolytes include polyacrylic acid (PAA) having a molecular weight of about 1,000–10,000, polyacrylic acid-co-maleic acid (PACM) having a molecular weight of about 2000–6000 and the like. In general, any neutralized form of a poly-carboxylic, phosphoric, sulfonic, sulfinic, etc. acid which can be readily dispersed, suspended or dissolved in a non-ionic, non-aqueous, moderately viscous medium such as PEG or an oil such as mineral oil and the like will function suitably as the source for the negatively charged species within the solvent medium. Multidentate monomeric electrolytes such as EDTA and its analogs may also function within this invention, although polyelectrolytes are functionally superior. The "non-neutralized" form of the above anionic electrolytes or polyelectrolytes (ie: anionic PE in the free acid state) do not function in this invention and have been shown not to enhance the Soft Settle characteristics of PEG suspensions of SiC. Only the "neutralized" form of the anionic PE or electrolyte will properly function.

According to the present invention, a novel suspension and/or lubricating "carrier" composition increases the efficiency and productivity of abrasion-type slicing units for slicing ingots made of brittle and hard material providing quality components for semiconductor, glass, ceramic and photocell wafer or sheet substrate. The lubricating composition of this invention maintains abrasive particles in non-agglomerating suspension to allow a more uniform delivery of these abrasive particles to the wedge-shaped spaces which are formed between the wire and the workpiece, or alternatively, at both ends of the cutting portion, with the result that the machinery accuracy and efficiency are greatly improved. Also, the lubricating composition provides lubrication to the slicing wire and absorbs the frictional heat generated at the cutting surfaces. Thus, these features prolong the service life of the wire or braid and minimizes any warping thickness variation or depth damage of the workpiece surfaces which deficiency cannot be tolerated in semiconductor optical glass or photocell devices.

A lubricating/suspension "carrier" composition for use with a wire cutting apparatus of this invention which can have up to about 70% abrasive material suspended within it comprises:

a) from about 0.0 to 5.0 weight percent of a surfactant;

b) about 0.05 to 10 weight percent of a polymeric polyelectrolyte having the same polarity chain pendant charge (i.e.; positive or negative) as said surfactant, and c) from about 80 to 99.5 weight percent of polyalkylene glycols, wherein the alkylene group contains 2–5 carbon atoms. Preferably, said glycols are selected from the group consisting of polyethylene glycol, polypropylene glycol, polyisobutylene glycol and their coglycols; and wherein said glycols consist of (on a total formulation weight percent basis) from about 80 to 99.5 weight percent of a glycol having a molecular weight of about 200–600, most preferably of about 200–400, whereby the viscosity ranges from about 50 to 300 cps, optionally d) from about 0.0–20.0 weight percent of a dispersing or suspension solvent other than the polyalkylene glycols such as those described in U.S. Pat. No. 6,054,422 and including, but not limited to, di- or tri-glycol monomethyl ether, NMP, DMAC and the like, and e) less than 10% by weight of water.

The abrasive material suitable for use in the above-recited composition may include diamond, silica, tungsten carbide, silicon carbide, boron carbide, silicon nitride, aluminum oxide or other hard grit "powder" material. One of the most preferred abrasive materials is silicon carbide. Generally, mean or average particle sizes range from about 5–50 microns; and preferably from 10–30 microns, depending on the international "FEPA or JIS" grade designations of the grit powder. The concentrations of the abrasive material in the suspensions medium typically may range from about 20 to 70 weight percent, preferably about 25 to 60 weight and most preferably about 35–55 weight percent.

Additional polar solvents, mentioned in (d) above, which are useful as suspension or dispersing agents include alcohols, amides, esters, ethers, ketones, glycol ethers or sulfoxides. Specifically, examples of polar solvents are dimethyl sulfoxide, dimethyl acetamide (DMAC), N-methyl pyrrolidone (NMP), (gamma) butyrolactone, di(ethylene glycol) ethyl ether, di(propylene glycol) methyl ether, tri (propylene glycol) monomethyl ether and the like.

A preferred suspension component of the present invention involves the combination of polyethylene glycol (PEG) having a molecular weight of 200–400, (i.e. total formulation weight of about 80–99%). The PEG base may comprise about 80 to 92 weight percent of the 200–600 (based on total formulation weight percent) and about 1 to 6 weight percent PEG 1000–2000 (based on total formulation weight percent) preferably about 85 to 90 weight percent PEG 400 and about 2 to 10 weight percent PEG 1500, and most preferably about 87–93 weight percent PEG 400 and about 3–8 weight percent PEG 1500.

The addition of a thickening agent in amounts up to about 10 percent by weight, advantageously a polysaccharide or a polysaccharide derivative, may be used to help ensure a more constant viscosity and stability of the lubricant dispersion over a wide temperature range, and for reducing the separation of the solids in the suspension during long stagnant conditions when viscosity requirements of the suspension allow. Suitable examples include xanthan gum, rhamsan gum or an alkyl-cellulose such as hydroxymethylcellulose, carboxymethylcellulose, and the like.

Just as anionic PE's can increase the repulsive forces between both particle-particle AND particle-charged medium through the concepts of "Zeta Potentials" of particles and charged species within the PEG medium, cationic polyelectrolytes (cationic PE) can accomplish the same principle. In this case, the long chain, multiple charged CATIONIC polyelectrolyte is efficiently attracted to the negatively charged SiC particles to form a tight electrostatic bonded "shell" all around the particle. Since the cationic polyelectrolyte, like the ANIONIC PE, has many charged pendant moieties along the polymer chain, those parts of the chain which are not adsorbed onto the particle surface electrostatically stick out from the particle as a positively charged "hair" or "string" into the non-ionic PEG medium.

The cationic PE's are most strongly charged under neutral to acidic conditions. This is because the most common type of CATIONIC PE'S are QUATERNARY AMMONIUM SALTS of various acrylates, acrylamides, methacryloxy, etc., polymers. Such "poly salts" typically will have a GENERAL repeating unit structure of the form:

$$(R_1)_{\alpha}\text{-}N(R)^{+}_{4-\alpha}\,X^{-}$$

where:

R=alkyl or H $R_1$=monomeric repeating unit of PE polymer as exampled above

X=halogen, sulfate, phosphate, sulfonate, or carboxylate anion $\alpha$=1–3 as integers In the case of the cationic PE's, these are strongly attached to the negatively charged abrasive particles electrostatically, neutralizing the negative charge on the particle and creating, at sufficient PE concentrations, a strong POSITIVE secondary charged "shell" around the particle caused by the unattached parts of the PE chain which carry pendant positive charges.

Generally, for cationic PE's, neutral or acidic pH is needed to prevent the ionic neutralization of the POSITIVE charge on the quarternary ammonium moiety by the following "general" Rx mechanism:

$$R{-}N(R_1)_4 + MOH + H_2O \xrightarrow{pH > 7\text{–}8} R{-}N(R_1)_4\,OH + M^+$$

(charged cationic PE) + (base) ⟶ (neutralized PE)

R=polymer chain separating unit $R_1$=H, alkyl

A similar result is given by the addition of alkali metal salts of polyacrylic acid, in particular sodium polyacrylate.

The suspensions according to the invention are very stable and, in many cases, even after long storage it is unnecessary to agitate the abrasive slurry before application to the wire cutting machines. However, if there is "separation" of the suspensions, only mild agitation is required to restore the slurry into a uniform suspension. Usually the action of the pump or spray to supply the cutting machine is sufficient to provide the necessary agitation following some initial recirculation.

The surfactants which can be used in the present compositions are the water soluble anionic or cationic surfactants.

Suitable anionic surface active agents include, for example, modified siloxanes and polysiloxane such as TEGOPREN 5863 and 5840, alkali metal, or more preferably non-metal salts of alkyl substituted benzene sulfonic acids, alkali metal or non-metal salts of long chain fatty sulphates, alkali metal or non-metal ether sulphates derived from alcohols and alkali phenols, alkali metal or non-metal sulpho-succinates, alkali metal or non-metal sarcosinates and alkali metal or non-metal taurides.

Preferred anionic surfactants include water miscible or dispersable alkyl dimethylamine oxides having 12 to 25 carbon atoms such as N,N-dimethyl-1-tetradecanamine oxide and N,N-dimethyl-1-octadecanamine oxide, sodium lauroyl sarcosinate, diphenyl ether sulfonates such as the alkali metal, or more preferably non-metal salts of hexadecyl diphenyl ether disulfonic acid, dodecyl diphenyl ether disulfonic and decyl diphenyl ether disulfonic acid, preferably $C_1$–$C_{18}$ alkylbenzene sulfonates. Commercially available anionic surfactants which may be used include mixtures of $C_{10}$–$C_{13}$ linear sodium alkylbenzene sulfonate marketed by De Soto or Stepan Corporation (a C 11–17 linear alkybenzene sulfonate). Calsoft F90 of Pilot Corporation (a $C_{10}$–$C_{13}$ sodium linear alkylaryl sulfonate), Witconate 90F of Witco Corporation (a $C_{12}$ sodium alkylaryl sulfonate containing 1.7% free oil and 3.0% $SO_4$), Nansa HS 80PF of Albright & Wilson Ltd., Stepan Agent S-1509-65 of Stepan Corporation (a $C_{13}$ calcium dodecylbenzene sulfonate), FC 170, FC-99, FC-95 which are fluorinated surfactants sold by 3M corporation. FSO-series of fluorinated surfactants sold by Dupont are also suitable.

Cationic surfactants which can be used in practicing the present invention include stearyl dimethyl benzyl ammonium chloride, coconut dimethyl benzyl ammonium chloride, cetyl pyridinium chloride, and cetyl trimethyl ammonium chloride.

Particularly, preferred surfactants for use herein are the fluorinated surfactants mentioned above, sodium and potassium alkyl naphthalene sulfonates having one or two alkyl groups containing about 1 to about 6 carbons each, and paraffin sulfonates having the formula $RSO_3M$, wherein R is a primary or secondary alkyl group containing from about 8 to about 22 carbon atoms (preferably about 12 carbon atoms), and M is an alkali metal.

The alkylene glycols and coglycols which can be used in the invention are commercially available from Aldrich, Union Carbide and others.

To quantitatively determine the level of "Soft-Settle" characteristics of a SiC slurry, a precise measurement tool was designed and constructed by PPT Research chemists and engineers. The "Soft-Settle Tool" essentially measures the resistance (in grams) to slurry penetration of a blunt-ended rod down to a predetermined depth or distance from a standard configuration shaped container bottom. A special conical-shaped standard tube is used to exacerbate the "Hard-Settle" propensity of the slurry, thereby distinguishing a "good" suspension carrier from a poor one. The tube contains a standard level of 15% grit (SiC). The level of grit chosen is arbitrary, but should be at a level for convenient tool measurement. 15% grit by weight is such a level.

So that the tool measures "cake-penetration resistance" in a repeatable and precise manner, both standard rod penetration depth and calibration of the tool are checked daily. For a slurry formed within an EXCELLENT suspension carrier, "Soft-Settle Readings" (i.e.; SSR) of penetration resistance are expected to be LOW; <25 g over long storage periods under controlled test conditions. For slurries formed within poor suspension carriers (like standard PEG-200, 300 or 400, for example), SSR's are typically in the region of 35–50 g (i.e.; HIGH) within quite short "storage" time periods. In other words, the lower the SSR for a given slurry over time, the more stable, uniform and better the slurry with respect to everything from performance to storage capability to recyclability.

The anionic polyelectrolytes can be neutralized by alkali metal bases such as sodium hydroxide or potassium hydroxide or by non-metallic alkyl ammonium hydroxides, for example, tetraalkylammonium hydroxide, preferably, tetramethyammonium hydroxide (TMAH).

The non-metallic hydroxides are preferred when low carrier viscosities and slurry viscosities are desirable.

When the metal hydroxides are utilized the carrier viscosities are generally greater than 100 cps and the slurry viscosities are generally greater than about 300–350 cps. The metal hydroxides are advantageously used to neutralize the anionic polyelectrolytes when the carrier is PEG 400 and anionic fluorinated or non-ionic surfactant is utilized. The resulting compositions have excellent viscosity maintenance with elevated temperatures.

The following examples are illustrative of the practice of the method of the present invention. It will be understood, however, that the listed examples are not to be construed in any way limitative of the full scope of the invention since various changes can be made without departing from the spirit of the teachings contained herein in light of the guiding principles which have been set forth above. All percentages stated herein are based on weight except where otherwise indicated.

EXAMPLE 1

A lubricating "carrier" composition for use with a multi-wire saw for cutting hard material was prepared by admixing the following ingredients:

| Ingredients | Wt % |
|---|---|
| PEG 200 | 94.5–97.5 |
| TMAH neutralized PACM* | 0.4–0.6 |
| Water | <5 |

*The average molecular weight of PACM in this example was about 2500–5000.

The pH of the composition was in the range of 4.7–5.5. The composition had a viscosity between 60–90 cps at 25° C. and a slurry viscosity with 47.1% SiC of about 240–290 cps at 25° C.

FIG. 1 illustrates the comparative viscosities of the composition of this example designated as SSL-160 at various temperatures as compared with PEG200 and PEG400.

EXAMPLE 2

A lubricating "carrier" composition was prepared for use with a multi-wire saw for cutting hard material wherein the grit content can be reduced about ⅓, namely, to about 35% SiC.

| Ingredients | Wt % |
|---|---|
| PEG 200 | 92.8–96.7 |
| TMAH neutralized PACM* | 1.8–2.2 |
| Water | <5 |

*The average molecular weight of the PACM was about 2500–5000.

The pH of the composition was about 4.7–5.5.

The viscosity of the composition was between about 175–250 cps at 25° C.

The slurry viscosity with 35% SiC was between 400–500 cps at 25° C.

Figure 2:
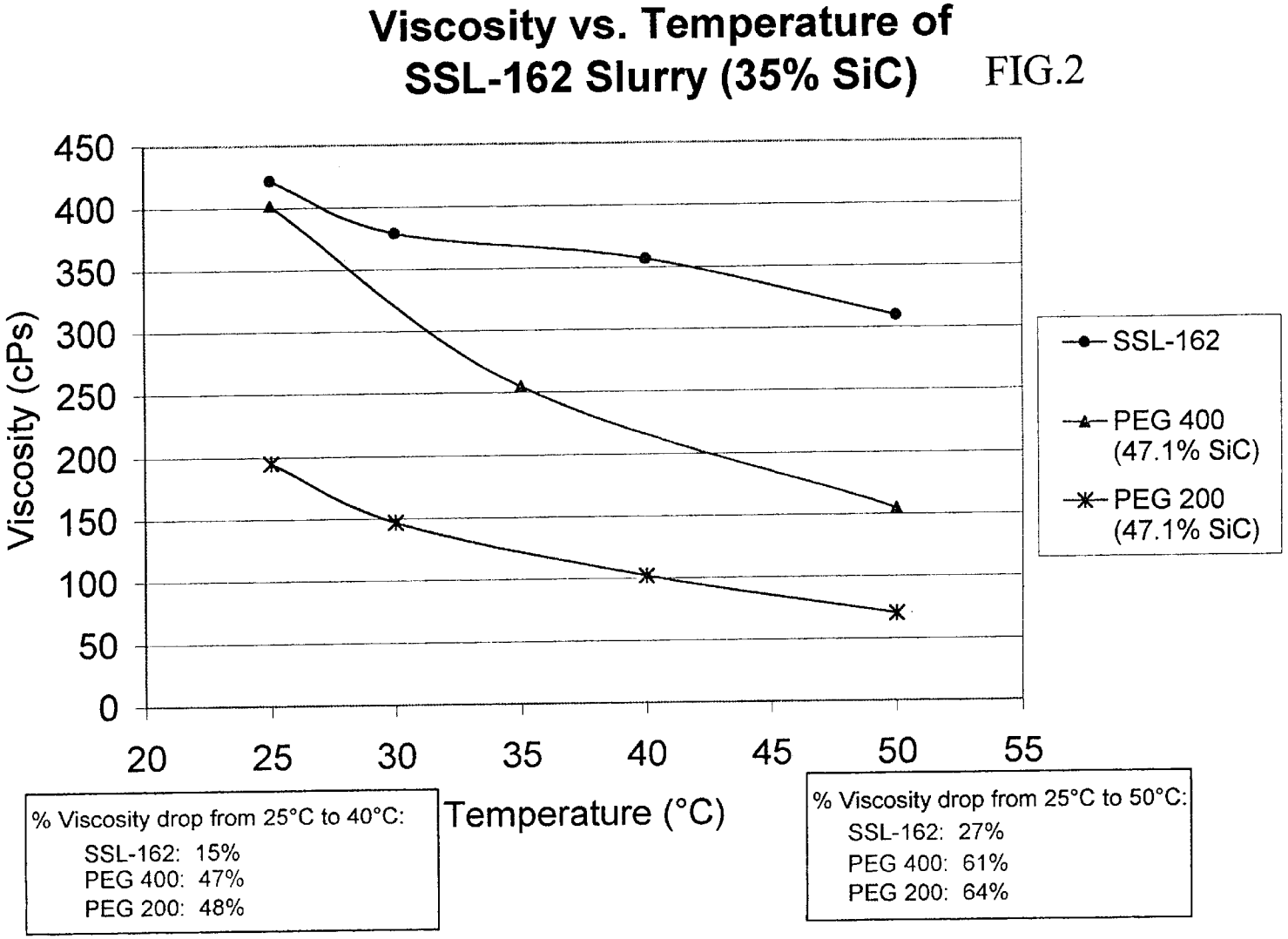
FIG. 2 illustrates comparative viscosities of another composition of the invention.

FIG. 2 illustrates the comparative viscosities of the composition of the example designated as SSL-162 at various temperatures as compared with PEG200 and PEG400.

EXAMPLE 3

A lubricating composition for use with a multi-wire saw for cutting hard material containing an anionic surfactant and an anionic polyelectrolyte was prepared by admixing the following ingredients.

| Ingredient | Wt. % |
|---|---|
| PEG 400 | 93.5–98.0 |
| KOH neutralized PACM | 0.5–2.5 |
| Fluoroalkyl surfactant* | 0.5–1 |
| Water | <3 |

*The fluorinated surfactant was a combination of amine salts of perfluoroalkyl sulfonates which was sold by 3M Corporation under the trademark FC-99, FC-98 and FC-95.

Other usable surfactants are the "Zonyl" series sold by Dupont Corporation under the trademarks FSO-Series and FSN-Series.

EXAMPLE 4

The following compositions containing 47–50% grit contain soft setting characteristics with a SSR of less than 25 after 35 days.

| Sample | Solvent | % Weight | Surfactant % Wt | Polyelectrolyte % Wt |
|---|---|---|---|---|
| A | PEG-400 | 96.5–99 | FC-99 0.5–1 | PAC M 0.5–2.5 |
| B | PEG-200 | 97.5–95 | FC-99 0.5–1 | PAC M 2–4 |
| C | PEG-400 | 95.5–83 | FC-170 0.5–1 | PAC M 2–4 |
| | TGME | 2–12 | | |

PAA = neutralized polyacrylic acid
PACM = neutralized polyacrylic acid-co-maleic acid
TGME = tripropylene glycol monomethyl ether

Comparative Example

The following is the measurement of soft settle readings at 25° C. of the samples of Example 4.

| Sample | Day 1 | Day 2 | Day 7 |
|---|---|---|---|
| A | 0 | 0 | 0 |
| B | 0 | 0 | 0 |
| C | 0 | 0 | 0 |
| PEG-400 | 30 | 45 | 45 |
| PEG-400 (0.5% FC-99) | 0 | 0 | 30 |
| PEG-200 (0.5% FC-99) | 5 | 45 | 45 |
| C (0.5% $H_2O$) | 0 | 0 | 0 |
| C (5% $H_2O$) | 0 | 0 | 0 |
| C (10% $H_2O$) | 0 | 0 | 37 |

What is claimed is:

1. A particle repulsive suspension carrier composition for use in cutting workpieces of a hard and brittle material with a wiresaw, or other cutting or grinding tools comprising:

a) a from about 0 to 10.0 weight percent of an ionized surfactant;

b) from about 80 to 99 weight percent of a non-aqueous, non-ionic, polar solvent;

c) a neutralized organic electrolyte or polyeletrolyte having the same surface charge as the surfactant in an amount necessary to create an electrical or electrostatic repulsive force on abrasive or other particles placed in said composition, and;

d) from about 0.5 to about 10.0 weight percent of water, whereby particles are stabilized by electrostatic and steric repulsion.

2. The composition of claim 1 wherein said surfactant is anionic and said electrolyte or polyelectrolyte is anionic.

3. The composition of claim 2 wherein said surfactant is a fluoroalkyl surfactant.

4. The composition of claim 1 including about 0 to 10.0 weight percent of a polar non-polymeric suspension solvent used to adjust both suspension characteristics and viscosity.

5. The composition of claim 1 wherein said polyelectrolyte is cationic and has the general formula:

$$(R_1)_n\text{–}N(R)^+_{4-n}X^1$$

where

R is hydrogen or lower alkyl;

$R_1$ is a monomeric repeating unit;

X is halogen, sulfate, phosphate, sulfonate or carboxylate; and n is an integer of 1 to 3.

6. The composition of claim 5 in which the pH is less than 7.0.

7. The composition of claim 1 wherein said polyelectrolyte is a neutralized polymeric acid.

8. The composition of claim 7 wherein said neutralized polyelectrolyte is selected from the group consisting of polyacrylic acid, poly-methacrylic acid, co-polymers of acrylic acid, methacrylic acid, maleic acid, and mixtures thereof.

9. The composition of claim 1 including particles of a hard abrasive material.

10. The composition of claim 1 wherein said polyelectrolyte has a molecular weight between about 1000 and 1 million.

11. The composition of claim 1 wherein said polyelectrolyte is a neutralized anionic electrolyte or polyelectrolyte which is neutralized with a base to a composition pH of about 4.5 to 8.0.

12. The composition of claim 1 wherein said polyelectrolyte is cationic and selected from the group consisting of poly-L-lysine, poly-L-proline and N-quaternized polymer.

13. The composition of claim 12 wherein said quaternized polymer is polyaminoepoxychlorohydrin.

14. The composition of claim 12 wherein the cationic polyelectrolyte is neutralized to a pH of less than 7.

15. The composition of claim 1 wherein said polyelectrolyte is neutralized with tetraalkyl ammonium hydroxide to a composition pH of about 4.6–8.0.

16. The composition of claim 1 including about 30 to 50% by weight of abrasive particles.

17. In a method for cutting workpieces of hard and brittle material with a wiresaw, or other cutting or grinding methods, the improvement which comprises providing the lubricating suspension carrier composition of claim 1 with abrasive particles suspended therein.

* * * * *